US010762864B2

(12) United States Patent
Zhang et al.

(10) Patent No.: US 10,762,864 B2
(45) Date of Patent: Sep. 1, 2020

(54) PIXEL CIRCUIT, DISPLAY PANEL AND DRIVE METHOD THEREOF

(71) Applicant: BOE TECHNOLOGY GROUP CO., LTD., Beijing (CN)

(72) Inventors: Shunhang Zhang, Beijing (CN); Yue Jia, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/404,922

(22) Filed: May 7, 2019

(65) Prior Publication Data

US 2020/0135125 A1 Apr. 30, 2020

(30) Foreign Application Priority Data

Oct. 30, 2018 (CN) ..... 2018 1 1284578

(51) Int. Cl.
*G09G 3/36* (2006.01)

(52) U.S. Cl.
CPC ..... *G09G 3/3648* (2013.01); *G09G 3/3696* (2013.01); *G09G 2300/0426* (2013.01); *G09G 2300/0465* (2013.01); *G09G 2300/0478* (2013.01); *G09G 2300/0871* (2013.01); *G09G 2330/021* (2013.01)

(58) Field of Classification Search
CPC ..... G09G 2300/0465; G09G 3/3648; G09G 2300/0426; G09G 2300/0478; G09G 2330/021; G09G 3/3696
See application file for complete search history.

(56) References Cited

U.S. PATENT DOCUMENTS

2013/0221339 A1* 8/2013 Kim ..... G09G 3/3233 257/40
2015/0236052 A1* 8/2015 Okamoto ..... G06F 3/0412 257/43
2016/0181341 A1* 6/2016 Lee ..... H01L 27/1222 257/40
2017/0323597 A1* 11/2017 Ota ..... G09G 3/3233

* cited by examiner

*Primary Examiner* — Abbas I Abdulselam

(74) *Attorney, Agent, or Firm* — The Webb Law Firm

(57) ABSTRACT

There is provided a pixel circuit, a display panel, a drive method. The pixel circuit comprises a switch sub-circuit, a storage sub-circuit, a drive sub-circuit. The switch sub-circuit is connected to a gate line, a data line, the storage sub-circuit, and configured to transmit a signal on the data line to the storage sub-circuit under control of a signal on the gate line. The storage sub-circuit is connected to a first voltage terminal, a second voltage terminal, and the drive sub-circuit, and configured to transmit a signal of the first voltage terminal or the second voltage terminal to the drive sub-circuit under control of the switch sub-circuit. The drive sub-circuit is connected to the first voltage terminal, the second voltage terminal, a pixel electrode, and configured to transmit the signal of the first voltage terminal or the second voltage terminal to the pixel electrode under control of the storage sub-circuit.

19 Claims, 5 Drawing Sheets

PIXEL CIRCUIT, DISPLAY PANEL AND DRIVE METHOD THEREOF

CROSS-REFERENCE TO RELATED APPLICATIONS

This application claims priority to Chinese Patent Application No. 201811284578.9, filed on Oct. 30, 2018, the content of which is incorporated herein by reference in its entirety for all purposes.

TECHNICAL FIELD

The present disclosure relates to a pixel circuit, a display panel and a drive method thereof.

BACKGROUND

MIP (Memory in Pixel) technology is widely applied in wearable products due to its characteristic of low power consumption. MIP-SPI (Serial Peripheral Interface) technology integrates integrated circuits into a display panel. Wearable products produced by utilizing the MIP-SPI technology have lower power consumption and can stand by for up to a month. Whereas in a RAM MIP structure for a pixel, each pixel circuit is disposed with four signal lines including a high level voltage VDD, a low level voltage VSS, and a forward reference potential FRP and a reverse reference potential XFRP generated by a signal generation sub-circuit (also referred as Vcom sub-circuit).

There is a need for an improved pixel circuit and display panel.

SUMMARY

Embodiments of the present disclosure provide a pixel circuit, a display panel and a drive method thereof.

In an aspect, the present disclosure provides a pixel circuit comprising: a switch sub-circuit, a storage sub-circuit, and a drive sub-circuit; the switch sub-circuit is connected to a gate line, a data line, and the storage sub-circuit, and is configured to transmit a signal on the data line to the storage sub-circuit under the control of a signal on the gate line; the storage sub-circuit is connected to a first voltage terminal, a second voltage terminal, and the drive sub-circuit, and is configured to transmit a signal of the first voltage terminal or the second voltage terminal to the drive sub-circuit under the control of the switch sub-circuit; the drive sub-circuit is connected to the first voltage terminal, the second voltage terminal, and a pixel electrode, and is configured to transmit the signal of the first voltage terminal or the second voltage terminal to the pixel electrode under the control of the storage sub-circuit.

In an example, the pixel circuit further comprises a common electrode; a voltage of the common electrode coincides with a voltage of the second voltage terminal when a black image is displayed; a difference between the voltage of the common electrode and a voltage of the first voltage terminal is alternating H and −H when a white image is displayed; wherein H is not equal to 0.

In an example, the switch sub-circuit comprises a first transistor with a gate connected to the gate line, a first electrode connected to the data line, and a second electrode connected to a first node of the storage sub-circuit.

In an example, the storage sub-circuit comprises a second transistor, a third transistor, a fourth transistor, and a fifth transistor; the second transistor has a gate connected to the first node, a first electrode connected to the first voltage terminal, and a second electrode connected to a second node of the storage sub-circuit; the third transistor has a gate connected to the first node, a first electrode connected to the second voltage terminal, and a second electrode connected to the second node; the fourth transistor has a gate connected to the second node, a first electrode connected to the first voltage terminal, and a second electrode connected to the first node; the fifth transistor has a gate connected to the second node, a first electrode connected to the second voltage terminal, and a second electrode connected to the first node; wherein, one of the second transistor and the third transistor is one of N-type and P-type transistors, and the other is the other of N-type and P-type transistors, one of the second transistor and the third transistor is one of N-type and P-type transistors.

In an example, the drive sub-circuit comprises a sixth transistor and a seventh transistor; the sixth transistor has a gate connected to the second node, a first electrode connected to the first voltage terminal, and a second electrode connected to the pixel electrode; the seventh transistor has a gate connected to the first node, a first electrode connected to the second voltage terminal, and a second electrode connected to the pixel electrode.

In an example, the first voltage terminal is a high level voltage terminal, and the second voltage terminal is a low level voltage terminal.

In an example, the second transistor and the fourth transistor are P-type transistors; the first transistor, the third transistor, the fifth transistor, the sixth transistor, and the seventh transistor are N-type transistors.

In another aspect, the present disclosure provides a display panel comprising any of the foregoing pixel circuits.

In yet another aspect, the present disclosure provides a drive method for any of the foregoing display panels, the drive method comprising: when a black image is displayed, supplying a DC voltage to a common electrode, a difference between a voltage of the common electrode and a voltage of the second voltage terminal is 0; when a white image is displayed, supplying an AC voltage is to the common electrode, a difference between the voltage of the common electrode and a voltage of the first voltage terminal is H and −H.

BRIEF DESCRIPTION OF THE DRAWINGS

To describe the technical solutions in the embodiments of the present disclosure or the prior art more clearly, the accompanying drawings used in the description of the embodiments or the prior art are briefly introduced in the following. Evidently, the accompanying drawings in the following description are only some embodiments of the present disclosure, and those of ordinary skill in the art may also obtain other drawings according to these accompanying drawings without creative efforts.

DETAILED DESCRIPTION

Technical solutions of embodiments of the present disclosure are clearly and completely described in the following in connection with the accompanying drawings in the embodiments of the present disclosure. Evidently, the embodiments described are only a part rather than all of the embodiments of the present disclosure. Based on the embodiments of the present disclosure, all other embodiments obtained by those of ordinary skill in the art without creative effects shall fall within the protection scope of the present disclosure.

In a RAM MIP structure for a pixel, each pixel circuit is disposed with four signal lines including a high level voltage VDD, a low level voltage VSS, and a forward reference potential FRP and a reverse reference potential XFRP generated by a signal generation sub-circuit (also referred as Vcom sub-circuit). These four signal lines are distributed across the entire display panel, which will cause a more complicated structure on the display panel. Furthermore, the two signals FRP and XFRP are normally square wave signals of 60 Hz, which consume larger power in a low frequency display mode, thereby leading to a larger power consumption for the entire display panel.

The embodiments of the present disclosure provide a pixel circuit, a display panel and a drive method thereof, which can solve the problem that the circuit structure is complicated and the display panel consumes large power due to a large number of signal lines in the pixel circuit.

Figure 1:
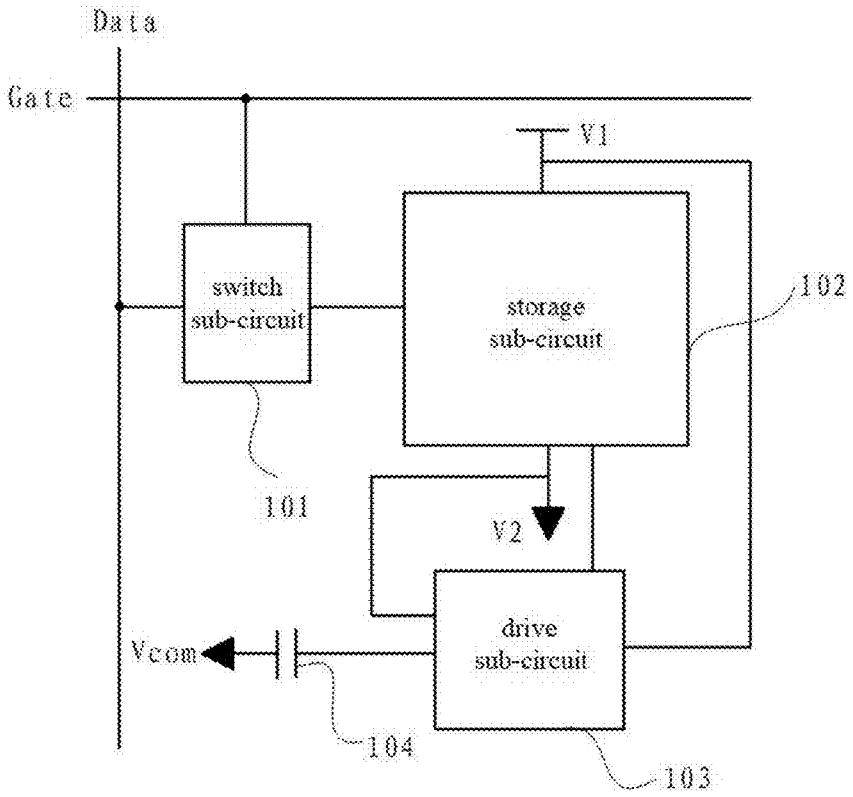
FIG. 1 is a structural schematic diagram of a pixel circuit provided by an embodiment of the present disclosure.

An embodiment of the present disclosure provides a pixel circuit, as shown in FIG. 1, comprising a switch sub-circuit 101, a storage sub-circuit 102, and a drive sub-circuit 103. The switch sub-circuit 101 is connected to a gate line Gate, a data line Data, and the storage sub-circuit 102, and is configured to transmit a signal on the data line Data to the storage sub-circuit 102 under the control of a signal on the gate line Gate. The storage sub-circuit 102 is connected to a first voltage terminal V1, a second voltage terminal V2, and the drive sub-circuit 103, and is configured to transmit a signal of the first voltage terminal V1 or the second voltage terminal V2 to the drive sub-circuit 103 under the control of the switch sub-circuit 101. The drive sub-circuit 103 is connected to the first voltage terminal V1, the second voltage terminal V2, and a pixel electrode 104, and is configured to transmit the signal of the first voltage terminal V1 or the second voltage terminal V2 to the pixel electrode 104 under the control of the storage sub-circuit 102.

Figure 2:
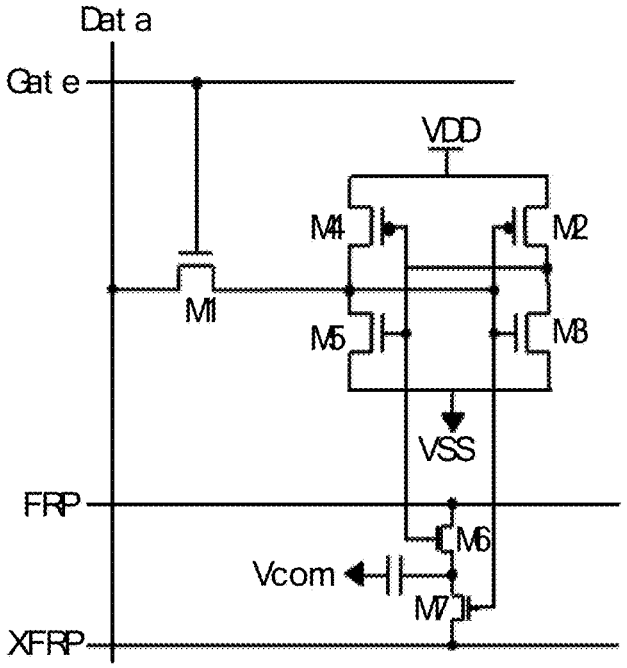
FIG. 2 is a structural schematic diagram of a pixel circuit provided by the related art.
Figure 5:
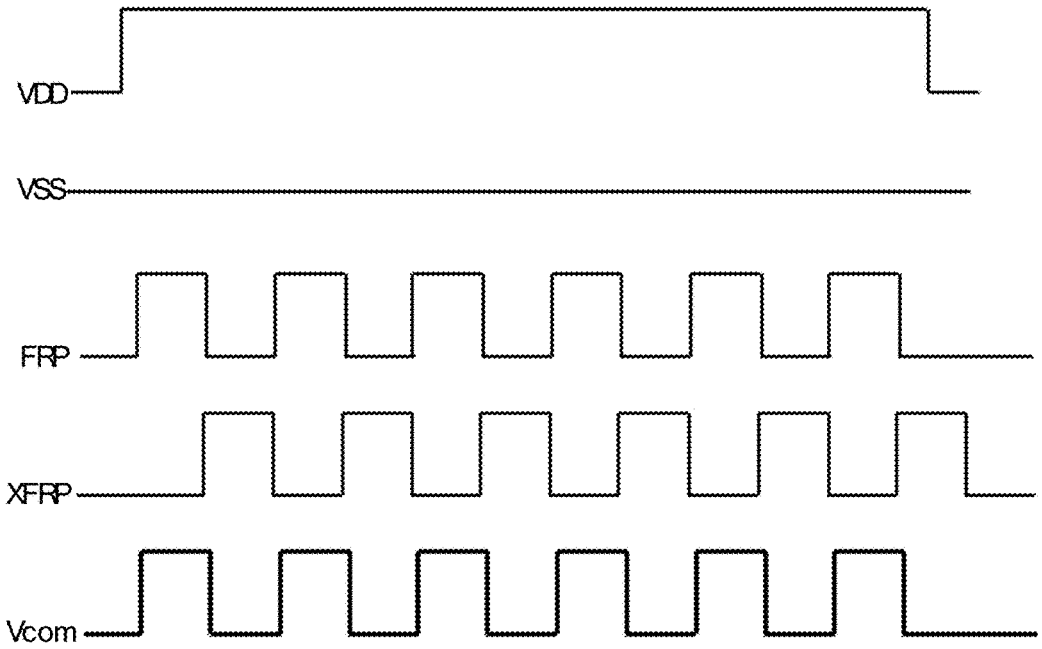
FIG. 5 is a timing diagram of individual signals for driving the display panel provided by the related art.

One of the first voltage terminal V1 and the second voltage terminal V2 is a high level voltage terminal VDD, and the one is a low level voltage terminal VSS. FIG. 2 and FIG. 5 show examples in which the first voltage terminal V1 is the high level voltage terminal VDD and the second voltage terminal V2 is the low level voltage terminal VSS. It should be noted that the high and low herein only represent a relative magnitude relationship between input voltages, the specific values of which are not limited by the embodiments of the present disclosure and may be set by those skilled in the art according to actual conditions.

The specific structures of the switch sub-circuit 101, the storage sub-circuit 102, and the drive sub-circuit 103 are not limited by the embodiments of the present disclosure as long as respective functions are realized.

In this way, the pixel circuit provided by the embodiment of the present disclosure multiplexes the first voltage terminal and the second voltage terminal through connecting the drive sub-circuit to the first voltage terminal and the second voltage terminal, which are enabled to function as the high and low levels as well as FRP and XFRP (i.e., write functions for white signal and black signal). This enables the original two signal lines FRP and XFRP to be removed, thereby resulting in a display panel with simpler wiring, larger pixel space, and lower power consumption.

In an example, with reference to FIG. 6 to FIG. 9, the pixel circuit further comprises a common electrode. A voltage Vcom of the common electrode coincides with a voltage of the second voltage terminal V2 when a black image is displayed. A difference between the voltage Vcom of the common electrode and a voltage of the first voltage terminal V1 is alternating H and −H when a white image is displayed; wherein H is not equal to 0.

In the related art, as shown in FIG. 2 to FIG. 5, VDD is always the high level, VSS is always the low level, which function to provide high and low level inputs for the pixel. FRP is a black display signal with a high or low level coinciding with Vcom, a voltage difference between FRP and Vcom is 0 V, liquid crystals are not deflected and the image is displayed as black. XFRP is a white display signal with a high or low level opposite to Vcom, a voltage difference is a voltage of 1H and the image is displayed as white; since XFRP cannot always be the high level or the low level when the display panel is displaying as this may cause the polarization of the liquid crystals, the XFRP signal is alternating between high and low levels, the corresponding Vcom and FRP signals are signals alternating between the high and low levels as well.

Figure 6:
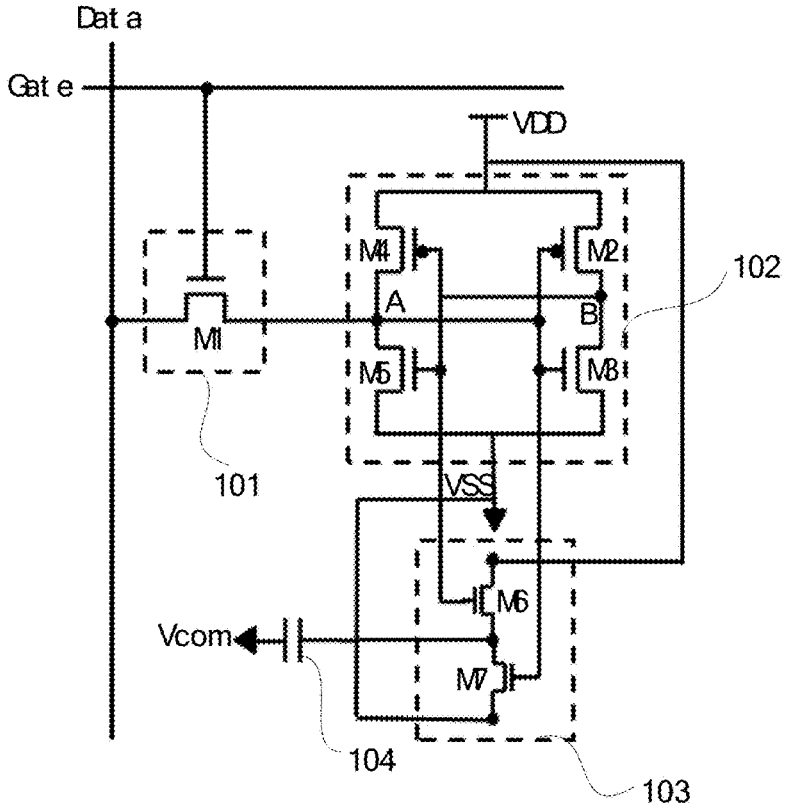
FIG. 6 is a structural schematic diagram of a pixel circuit provided by an embodiment of the present disclosure.
Figure 7:
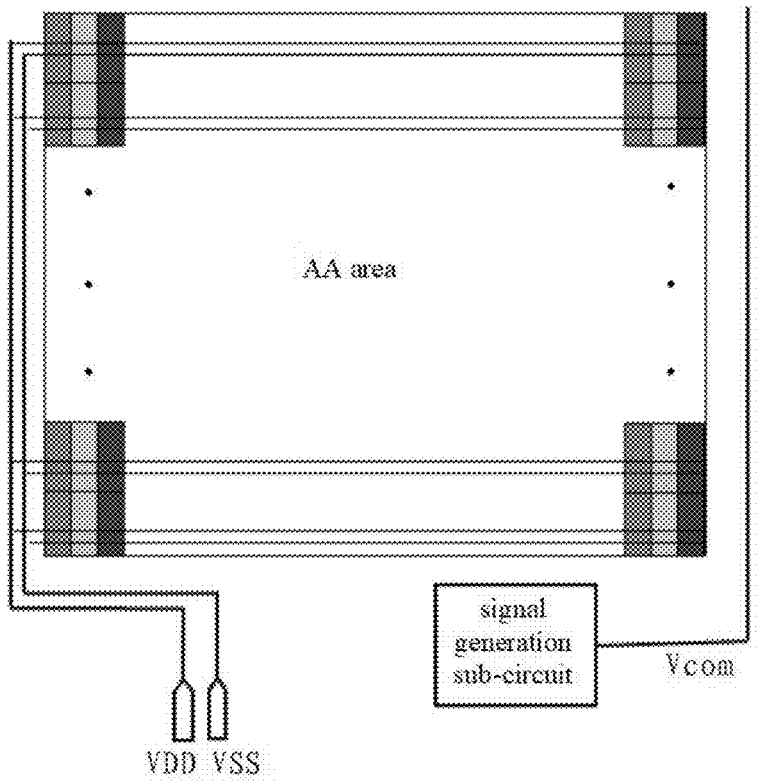
FIG. 7 is a structural schematic diagram of a display panel provided by an embodiment of the present disclosure.
Figure 8:
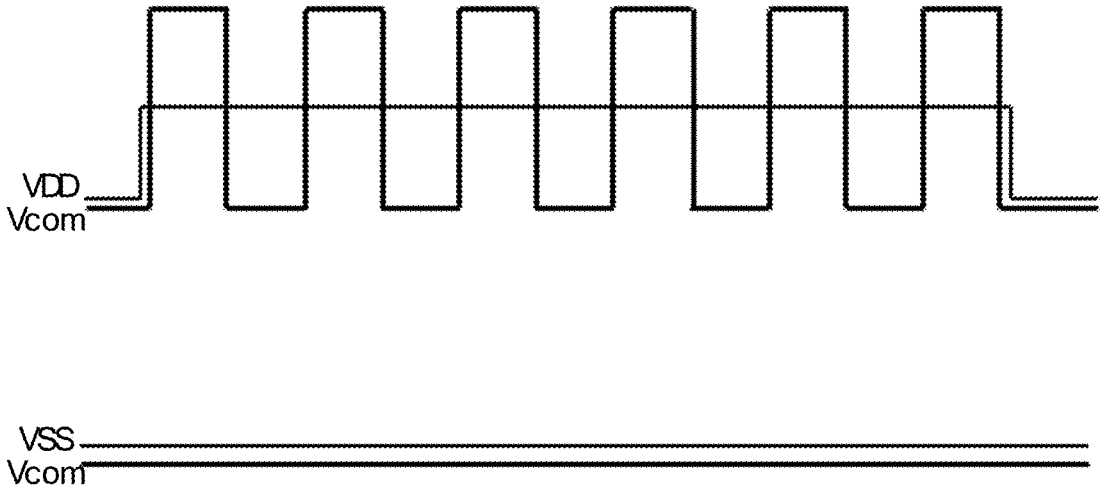
FIG. 8 is a timing diagram of individual signals for driving the display panel provided by an embodiment of the present disclosure.

In the embodiment of the present disclosure, with reference to FIG. 6 to FIG. 8, after employing VDD and VSS multiplexed as FRP and XFRP functions, VDD and VSS do not switch their high or low levels in the display phase as they are DC voltages. In this way, the liquid crystals are always under one bias when the display panel is displaying, which may cause polarization problem. In the present disclosure, the voltage of Vcom is changed, as shown in FIG. 8, when the display is white, a AC voltage with a high voltage of 2H and a unchanged low voltage may be input into the common electrode such that the voltage difference between Vcom and VDD becomes H and −H, switching between the positive and the negative may enable the liquid crystals to be deflected and avoid the polarization problem. Whereas when the display is black, a DC voltage same as VSS may be input into the common electrode, at this moment the liquid crystals remain unmoved and the display is black.

Figure 3:
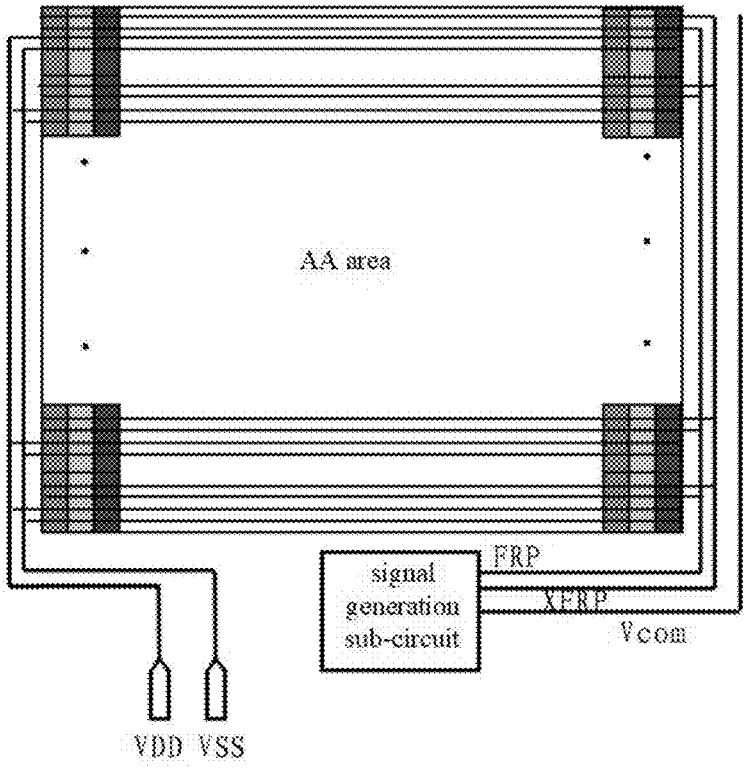
FIG. 3 is a structural schematic diagram of a display panel provided by the related art.
Figure 4:
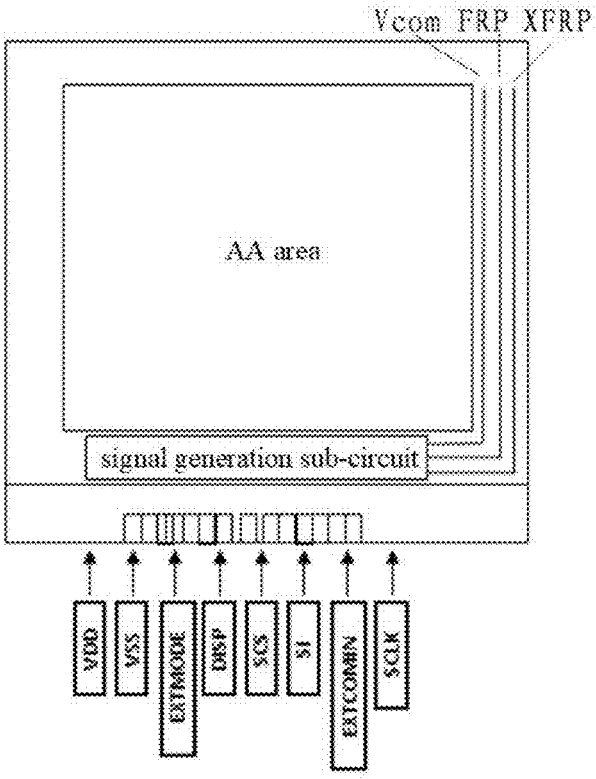
FIG. 4 is a schematic diagram of individual signal source interfaces of the display panel provided by the related art.
Figure 9:
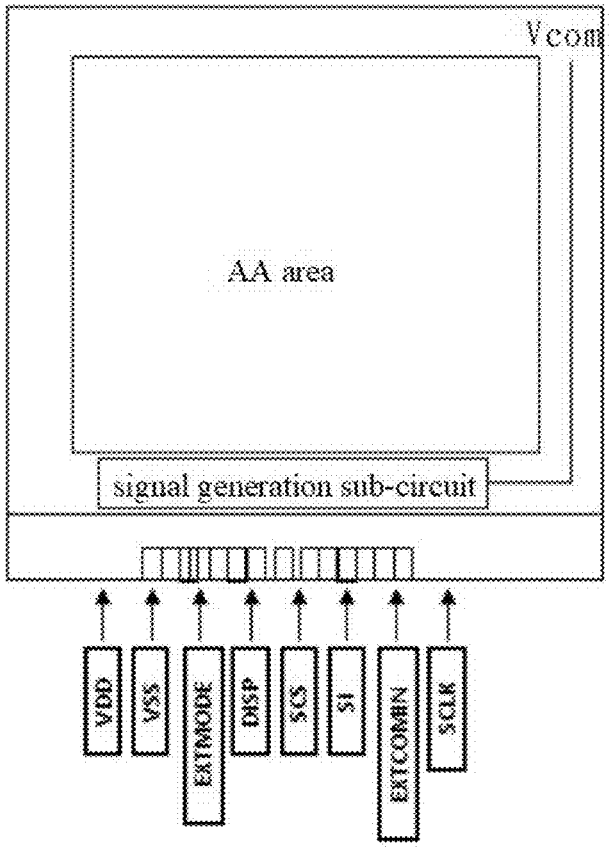
FIG. 9 is a schematic diagram of individual signal source interfaces of the display panel provided by an embodiment of the present disclosure.

Comparing FIG. 7 and FIG. 9 of the embodiments of the present disclosure with FIG. 3 and FIG. 4 of the related art, it can be seen that the signal generation sub-circuit in the embodiments of the present disclosure only needs to generate the Vcom signal without further generating the FRP and XFRP signals, such that after XFRP and FRP signal lines are removed, the structure of the signal generation sub-circuit may be simplified and the number of signal lines on the entire display panel may be reduced largely, further, many resistors and capacitors may be reduced, delays for the resistors and the capacitors may be reduced, and meanwhile the power consumption across the entire display panel may be reduced.

With reference to FIG. 6, in some embodiments of the present disclosure, the switch sub-circuit 101 comprises a first transistor M1 with a gate connected to the gate line Gate, a first electrode connected to the data line Data, and a second electrode connected to a first node A of the storage sub-circuit 102. FIG. 6 shows an example in which the first transistor M1 is a N-type transistor.

In actual applications, the switch sub-circuit 101 may further comprise multiple first transistors M1 in parallel. The above is merely the illustration of the switch sub-circuit 101 by way of examples, other structures with same functions as those of this switch sub-circuit are not described in detail herein but shall fall within the protection scope of the present disclosure.

With reference to FIG. 6, the storage sub-circuit 102 comprises a second transistor M2, a third transistor M3, a fourth transistor M4, and a fifth transistor M5, the second transistor M2 has a gate connected to the first node A, a first electrode connected to the first voltage terminal V1, and a second electrode connected to a second node B of the storage sub-circuit 102; the third transistor M3 has a gate connected to the first node A, a first electrode connected to the second voltage terminal V2, and a second electrode connected to the second node B; the fourth transistor M4 has a gate connected to the second node B, a first electrode connected to the first voltage terminal V1, and a second electrode connected to the first node A; the fifth transistor M5 has a gate connected to the second node B, a first electrode connected to the second voltage terminal V2, and a second electrode connected to the first node A; wherein, the second transistor M2 and the third transistor M3, as well as the fourth transistor M4 and the fifth transistor M5, are N-type and P-type transistors respectively, or P-type and N-type transistors respectively. FIG. 6 shows an example in which the second transistor M2 and the fourth transistor M4 are P-type transistors and the third transistor M3 and the fifth transistor M5 are N-type transistors.

In actual applications, the storage sub-circuit 102 may further comprise multiple switch transistors in parallel with the second transistor M2, and/or multiple switch transistors in parallel with the third transistor M3, and/or multiple switch transistors in parallel with the fourth transistor M4, and/or multiple switch transistors in parallel with the fifth transistor M5. The above is merely the illustration of the storage sub-circuit 102 by way of examples, other structures with same functions as those of the storage sub-circuit 102 are not described in detail herein but shall fall within the protection scope of the present disclosure.

With reference to FIG. 6, the drive sub-circuit 103 comprises a sixth transistor M6 and a seventh transistor M7; the sixth transistor M6 has a gate connected to the second node B, a first electrode connected to the first voltage terminal V1, and a second electrode connected to the pixel electrode 104; the seventh transistor M7 has a gate connected to the first node A, a first electrode connected to the second voltage terminal V2, and a second electrode connected to the pixel electrode 104. FIG. 6 shows an example in which the sixth transistor M6 and the seventh transistor M7 are N-type transistors.

In actual applications, the drive sub-circuit 103 may further comprise multiple switch transistors in parallel with the sixth transistor M6, and/or multiple switch transistors in parallel with the seventh transistor M7. The above is merely the illustration of the drive sub-circuit 103 by way of examples, other structures with same functions as those of the drive sub-circuit 103 are not described in detail herein but shall fall within the protection scope of the present disclosure.

In the above, it should be noted that the first electrodes of the above-described transistors may be drains and the second electrodes may be sources; or the first electrodes may be sources and the second electrodes may be drains. This is not limited by the embodiments of present disclosure.

A embodiment of the present disclosure provides a display panel comprising any of the foregoing pixel circuits. The pixel circuit provided by the embodiment of the present disclosure multiplexes the first voltage terminal and the second voltage terminal through connecting the drive sub-circuit to the first voltage terminal and the second voltage terminal, which are enabled to function as the high and low levels as well as FRP and XFRP (i.e., write functions for white signal and black signal). This enables the original two signal lines FRP and XFRP to be removed, thereby resulting in a display panel with simpler wiring, larger pixel space, and lower power consumption.

Yet another embodiment of the present disclosure provides a drive method for any of the foregoing display panels, the drive method comprising: when a black image is displayed, supplying a DC voltage to a common electrode, a difference between a voltage of the common electrode and a voltage of the second voltage terminal is 0; when a white image is displayed, supplying an AC voltage is to the common electrode, a difference between the voltage of the common electrode and a voltage of the first voltage terminal is H and −H, wherein H is a number not equal to 0.

The above is merely the detailed description of the present disclosure, but the protection scope of the present disclosure is not limited to this. Variations or replacements that can be easily considered by any skilled person familiar with the art within the technical range disclosed by the present disclosure shall be encompassed within the protection scope of the present disclosure. Therefore, the protection scope of the present disclosure shall be subject to the protection scope of the claims.

What is claimed is:

1. A pixel circuit, comprising:

a switch sub-circuit, a storage sub-circuit, and a drive sub-circuit; wherein:

the switch sub-circuit is connected to a gate line, a data line, and the storage sub-circuit, and is configured to transmit a signal on the data line to the storage sub-circuit under the control of a signal on the gate line;

the storage sub-circuit is connected to a first voltage terminal, a second voltage terminal, and the drive sub-circuit, and is configured to transmit a signal of the first voltage terminal or the second voltage terminal to the drive sub-circuit under the control of the switch sub-circuit;

the drive sub-circuit is connected to the first voltage terminal, the second voltage terminal, and a pixel electrode, and is configured to transmit the signal of the first voltage terminal or the second voltage terminal to the pixel electrode under the control of the storage sub-circuit; and a common electrode; wherein:

a voltage of the common electrode coincides with a voltage of the second voltage terminal when a black image is displayed; and a difference between the voltage of the common electrode and a voltage of the first voltage terminal is alternating H and −H when a white image is displayed; wherein H is not equal to 0.

2. The pixel circuit of claim 1, wherein the switch sub-circuit comprises a first transistor, and wherein the first transistor has a gate connected to the gate line, a first electrode connected to the data line, and a second electrode connected to a first node of the storage sub-circuit.

3. The pixel circuit of claim 2, wherein:

the storage sub-circuit comprises a second transistor, a third transistor, a fourth transistor, and a fifth transistor, and the second transistor has a gate connected to the first node, a first electrode connected to the first voltage terminal, and a second electrode connected to a second node of the storage sub-circuit;

the third transistor has a gate connected to the first node, a first electrode connected to the second voltage terminal, and a second electrode connected to the second node;

the fourth transistor has a gate connected to the second node, a first electrode connected to the first voltage terminal, and a second electrode connected to the first node;

the fifth transistor has a gate connected to the second node, a first electrode connected to the second voltage terminal, and a second electrode connected to the first node; and one of the second transistor and the third transistor is one of N-type and P-type transistors, and the other is the other of N-type and P-type transistors, one of the fourth transistor and the fifth transistor is one of N-type and P-type transistors, and the other is the other of N-type and P-type transistors.

4. The pixel circuit of claim 3, wherein:

the drive sub-circuit comprises a sixth transistor and a seventh transistor;

the sixth transistor has a gate connected to the second node, a first electrode connected to the first voltage terminal, and a second electrode connected to the pixel electrode; and the seventh transistor has a gate connected to the first node, a first electrode connected to the second voltage terminal, and a second electrode connected to the pixel electrode.

5. The pixel circuit of claim 1 wherein the first voltage terminal is a high level voltage terminal, and the second voltage terminal is a low level voltage terminal.

6. The pixel circuit of claim 4, wherein the second transistor and the fourth transistor are P-type transistors; the first transistor, the third transistor, the fifth transistor, the sixth transistor, and the seventh transistor are N-type transistors.

7. The pixel circuit of claim 1, wherein the first voltage terminal is a high level voltage terminal, and the second voltage terminal is a low level voltage terminal.

8. A display panel comprising the pixel circuit of claim 1.

9. The display panel of claim 8, further comprising a common electrode; wherein:

a voltage of the common electrode coincides with a voltage of the second voltage terminal when a black image is displayed; and a difference between the voltage of the common electrode and a voltage of the first voltage terminal is alternating H and −H when a white image is displayed; wherein H is not equal to 0.

10. The display panel of claim 8, wherein the switch sub-circuit comprises a first transistor, and wherein the first transistor has a gate connected to the gate line, a first electrode connected to the data line, and a second electrode connected to a first node of the storage sub-circuit.

11. The display panel of claim 10, wherein:

the storage sub-circuit comprises a second transistor, a third transistor, a fourth transistor, and a fifth transistor;

the second transistor has a gate connected to the first node, a first electrode connected to the first voltage terminal, and a second electrode connected to a second node of the storage sub-circuit;

the third transistor has a gate connected to the first node, a first electrode connected to the second voltage terminal, and a second electrode connected to the second node;

the fourth transistor has a gate connected to the second node, a first electrode connected to the first voltage terminal, and a second electrode connected to the first node;

the fifth transistor has a gate connected to the second node, a first electrode connected to the second voltage terminal, and a second electrode connected to the first node; and one of the second transistor and the third transistor is one of N-type and P-type transistors, and the other is the other of N-type and P-type transistors, one of the second transistor and the third transistor is one of N-type and P-type transistors.

12. The display panel of claim 11, wherein:

the drive sub-circuit comprises a sixth transistor and a seventh transistor;

the sixth transistor has a gate connected to the second node, a first electrode connected to the first voltage terminal, and a second electrode connected to the pixel electrode;

the seventh transistor has a gate connected to the first node, a first electrode connected to the second voltage terminal, and a second electrode connected to the pixel electrode.

13. The display panel of claim 12, wherein the second transistor and the fourth transistor are P-type transistors; the first transistor, the third transistor, the fifth transistor, the sixth transistor, and the seventh transistor are N-type transistors.

14. A drive method for a display panel comprising a pixel circuit, the pixel circuit comprising a switch sub-circuit, a storage sub-circuit, and a drive sub-circuit; wherein the switch sub-circuit is connected to a gate line, a data line, and the storage sub-circuit, and is configured to transmit a signal on the data line to the storage sub-circuit under the control of a signal on the gate line; the storage sub-circuit is connected to a first voltage terminal, a second voltage terminal, and the drive sub-circuit, and is configured to transmit a signal of the first voltage terminal or the second voltage terminal to the drive sub-circuit under the control of the switch sub-circuit; the drive sub-circuit is connected to the first voltage terminal, the second voltage terminal, and a pixel electrode, and is configured to transmit the signal of the first voltage terminal or the second voltage terminal to the pixel electrode under the control of the storage sub-circuit, the drive method comprising:

when a black image is displayed, supplying a DC voltage to a common electrode, a difference between a voltage of the common electrode and a voltage of the second voltage terminal is 0;

when a white image is displayed, supplying an AC voltage is to the common electrode, a difference between the voltage of the common electrode and a voltage of the first voltage terminal is H and −H.

15. The method of claim 14, the switch sub-circuit comprises a first transistor, wherein the first transistor has a gate connected to the gate line, a first electrode connected to the data line, and a second electrode connected to a first node of the storage sub-circuit.

16. The method of claim 15, wherein the storage sub-circuit comprises a second transistor, a third transistor, a fourth transistor, and a fifth transistor;

the second transistor has a gate connected to the first node, a first electrode connected to the first voltage terminal, and a second electrode connected to a second node of the storage sub-circuit;

the third transistor has a gate connected to the first node, a first electrode connected to the second voltage terminal, and a second electrode connected to the second node;

the fourth transistor has a gate connected to the second node, a first electrode connected to the first voltage terminal, and a second electrode connected to the first node;

the fifth transistor has a gate connected to the second node, a first electrode connected to the second voltage terminal, and a second electrode connected to the first node; and one of the second transistor and the third transistor is one of N-type and P-type transistors, and the other is the other of N-type and P-type transistors, one of the second transistor and the third transistor is one of N-type and P-type transistors.

17. The method of claim 16, wherein the drive sub-circuit comprises a sixth transistor and a seventh transistor;

the sixth transistor has a gate connected to the second node, a first electrode connected to the first voltage terminal, and a second electrode connected to the pixel electrode; and the seventh transistor has a gate connected to the first node, a first electrode connected to the second voltage terminal, and a second electrode connected to the pixel electrode.

18. The method of claim 17, wherein the second transistor and the fourth transistor are P-type transistors; the first transistor, the third transistor, the fifth transistor, the sixth transistor, and the seventh transistor are N-type transistors.

19. The method of claim 14, wherein the first voltage terminal is a high level voltage terminal, and the second voltage terminal is a low level voltage terminal.

* * * * *